United States Patent [19]

Weetman et al.

[11] Patent Number: 5,046,245

[45] Date of Patent: Sep. 10, 1991

[54] METHODS OF FABRICATING IMPELLER BLADES FOR MIXING APPARATUS

[75] Inventors: Ronald J. Weetman; Richard A. Howk, both of Rochester, N.Y.

[73] Assignee: General Signal Corporation, Stamford, Conn.

[21] Appl. No.: 587,507

[22] Filed: Sep. 21, 1990

Related U.S. Application Data

[60] Continuation of Ser. No. 415,511, Oct. 2, 1989, abandoned, which is a division of Ser. No. 31,307, Mar. 26, 1987, Pat. No. 4,896,971.

[51] Int. Cl.[5] ..... B21D 53/00

[52] U.S. Cl. ..... 29/889.7; 29/889; 72/379.2; 72/411

[58] Field of Search ..... 366/330, 331; 416/233 R, 244 R; 261/77, 84; 72/371, 379.2, 411, 702, 704; 29/889.7, 889

[56] References Cited

U.S. PATENT DOCUMENTS

| | | | |
|---|---|---|---|
| 3,058,511 | 10/1962 | Phillips | 72/371 |
| 3,580,039 | 5/1971 | Hinonen | 72/371 |
| 4,164,061 | 8/1979 | Bronovsky et al. | 29/156.8 B |
| 4,364,667 | 12/1982 | Reiner | 366/325 |
| 4,383,426 | 5/1983 | Legge | 29/156.8 B X |
| 4,845,992 | 7/1989 | Dean | 29/156.8 B X |

FOREIGN PATENT DOCUMENTS 1194385 11/1985 U.S.S.R. .

OTHER PUBLICATIONS

"Handbook of Metal Forming", Kurt Large, ed. 1985, McGraw Hill, N.Y., sect 2.18, 2.2.4 & chap. 19.

*Primary Examiner*—Irene Cuda

*Attorney, Agent, or Firm*—Martin Lukacher; Milton E. Kleinman

[57] ABSTRACT

A mixer impeller made up of paddle shaped blades, which near their tips (e.g., at 90% of the radius of the impeller from its axis of rotation) are of a width at least 40% of the impeller's diameter. The blades also having camber and twist. They are formed by establishing bending moments which form the blades into sections which are curved and flat, with the flat sections being at least in the center area of the base of the blades.

8 Claims, 10 Drawing Sheets

METHODS OF FABRICATING IMPELLER BLADES FOR MIXING APPARATUS

This is a continuation of application Ser. No. 415,511, filed Oct. 2, 1989, now abandoned, which is a division of application Ser. No. 031,307, filed Mar. 26, 1987, now U.S. Pat. No. 4,896,971, issued Jan. 30, 1990.

The present invention relates to methods of fabricating impeller blades for mixing apparatus for circulating liquids and liquid suspensions in a tank or other region, which includes a plurality of blades.

The invention is especially suitable for use in making impellers for use in fabricating impellers for applications where gas, such as air or oxygen, is sparged and mixed with and dissolved into the liquid or liquid suspension being circulated in the tanks and wherever large axial flow of a liquid or liquid suspension is desired. The method of fabricating an impeller blade in accordance with the invention may be used to make blades for various mixing impellers out of metal plates.

Radial flow impellers with blades in the form of paddles perpendicular to the direction of rotation and pitched blade turbines with paddles inclined at 45° to the angle of rotation have been used to circulate liquids and liquid suspensions. Such large flow volumes are believed to facilitate the sparging or mixing and dissolving of gases such as air and oxygen into the medium being mixed. While axial flow impellers have been used in sparging applications, their use has been limited to applications where large gas volumes are relatively easy to disperse, as in waste water treatment.

In addition providing large flow volume so as to maximize gas handling while still providing a predominantly axial flow, a critical problem of reliability of the mixing impeller has presented itself. The environment about the impeller is one which gives rise to large variable loads on the impeller blades. The variable loads are believed to be due to the non-uniform flow field presented by the circulating medium and the gas bubbles therein which tend to travel in a direction opposite to the direction of pumping. Pumping by the impeller is normally in a downward direction so that axial flow downwardly and then upwardly along the sides of the tank occurs. Such flow must be maintained in large volume in order to prevent flooding. Flooding is a condition where the gas is not driven with the circulating fluid, but rather moves against the fluid flow. On flooding, a turbulent boiling condition appears at the surface of the tank. In the presence of such non-uniform flow fields the blades can fail at their attachment to the shaft, which is usually at the hub which connects the impeller blades to the shaft. Merely applying more turning power to the shaft does not solve the blade failure problem, since the loads on the blades at their attachment are only increased. Moreover, operating the mixer at increased power is undesirable in that the cost of energy is a principal factor in the cost of the, process.

It is object of the present invention to provide an improved method of fabricating the blades for a mixing impeller from metal plate so as to enable such blades to be produced repeatedly with the same shape and at low cost.

It is another object of the present invention to provide an improved method of fabricating blades of mixing impellers so as to provide them with complex curves having airfoil shape suitable for an impeller providing predominantly axial flow.

It is still another object of the present invention to provide an improved method of fabricating impeller blades with both curved and flat surfaces, the flat surfaces providing a means for reliable, secure attachment to the hub of an impeller shaft.

The blades may, in accordance with the invention, be provided with the requisite shape by bending a plate between tools (air bending) which define two pairs of parallel lines of contact, one pair of which are on one side of the blade and closer than the lines of contact on the opposite side of the plate. Bending upon pressing of the tools together results in a curve along an arc in a portion of the blade, preferably closer to its leading edge than its trailing edge. This curve may be along a diagonal rather than perpendicular to the tip and base of the rectangular plate. The curve provides camber which extends between the tip and the base and which varies so as to define a twist to the blade. However, the bending leaves a section along the base of the plate which is flat so as to facilitate connection to the arms of the hub. Such connection can be made by bolts extending through aligned holes in the arm, backing plate and the blade. Since the attachment members are flat, the bolts are not cocked and provide uniform holding forces, maintaining their pre-load, which would not be the case for attachment of curved members.

The foregoing and other objects, features and advantages of the invention as well as the preferred embodiment and best mode of practicing the invention will become more apparent from a reading of the following description in connection with the accompanying drawing in which.

Figure 1:
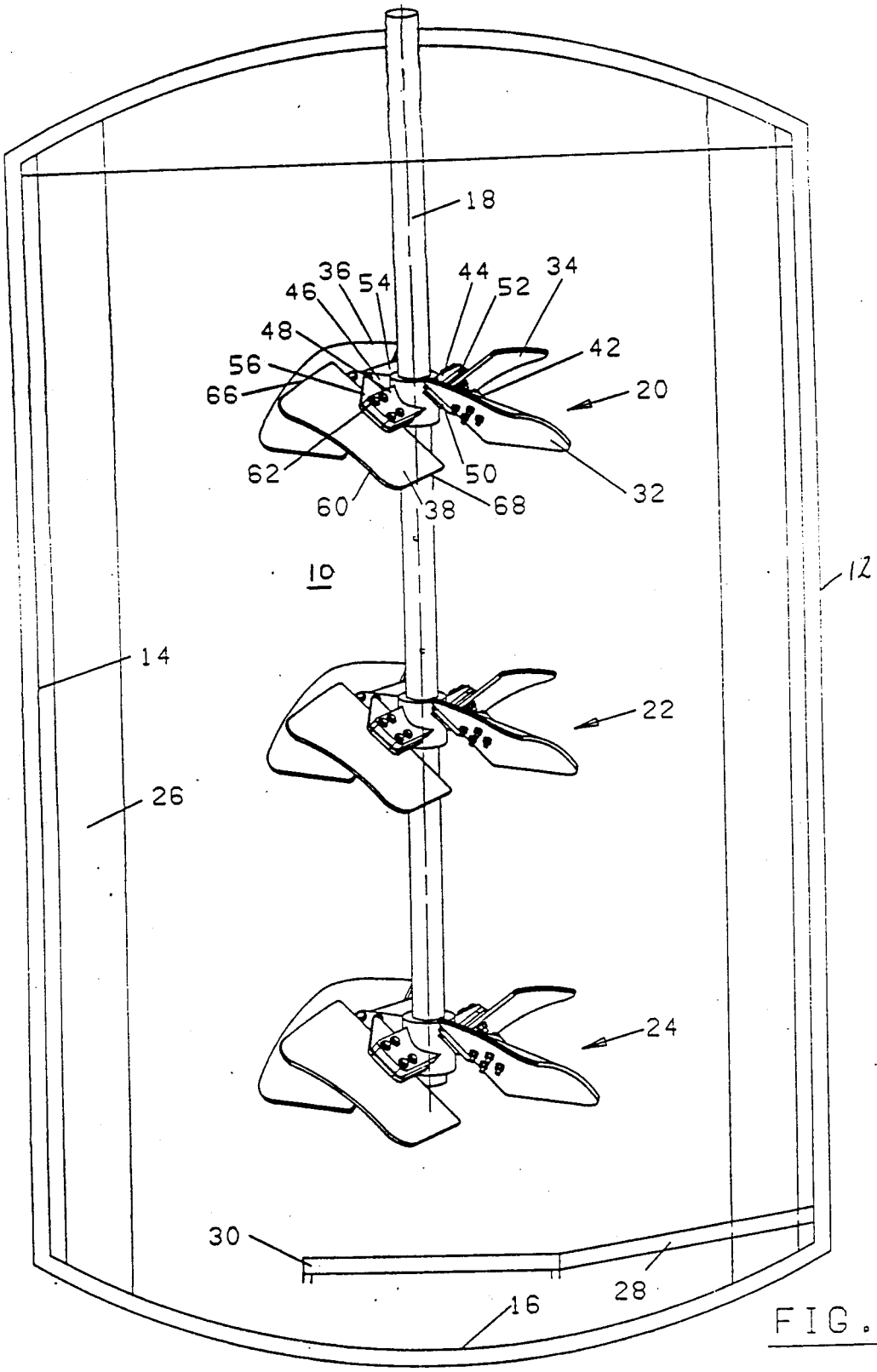
FIG. 1 is a perspective view looking downwardly at a slight angle into a tank and showing a mixer having a plurality of impellers on shaft disposed in the tank.
Figure 2:
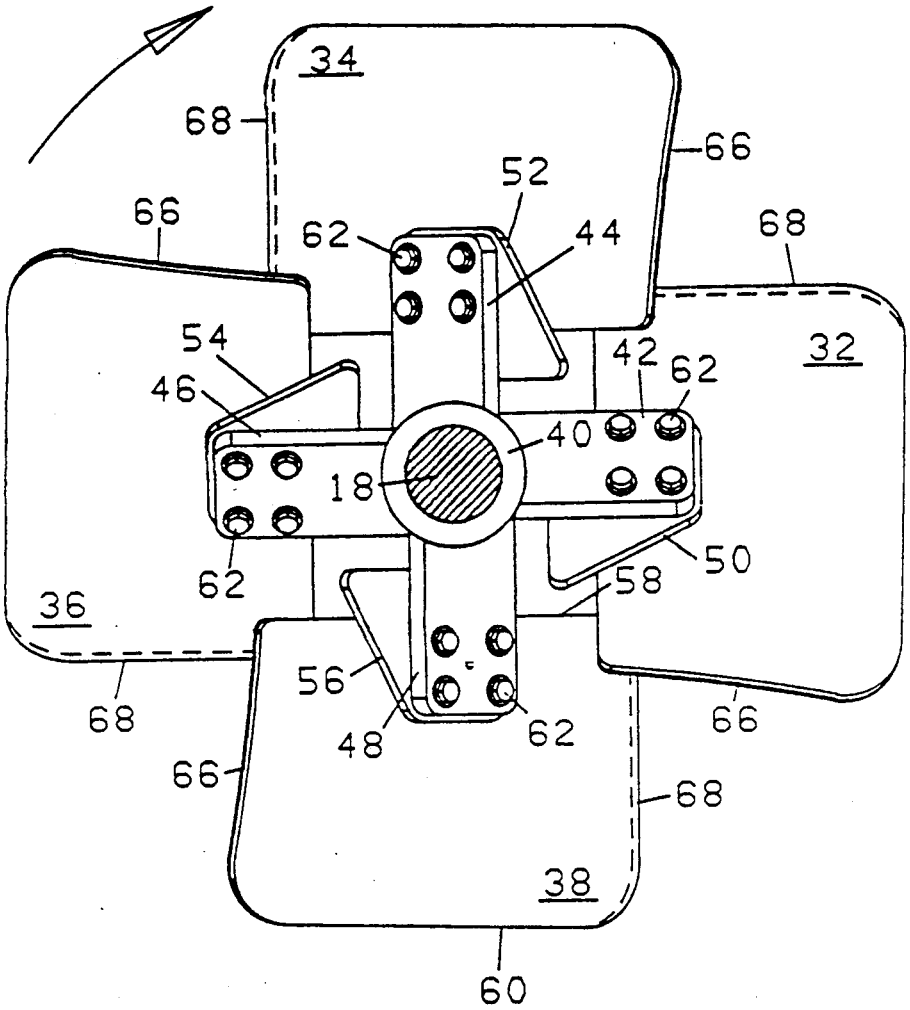
FIG. 2 is a view from the top of one of the impellers shown in FIG. 1.
Figure 3:
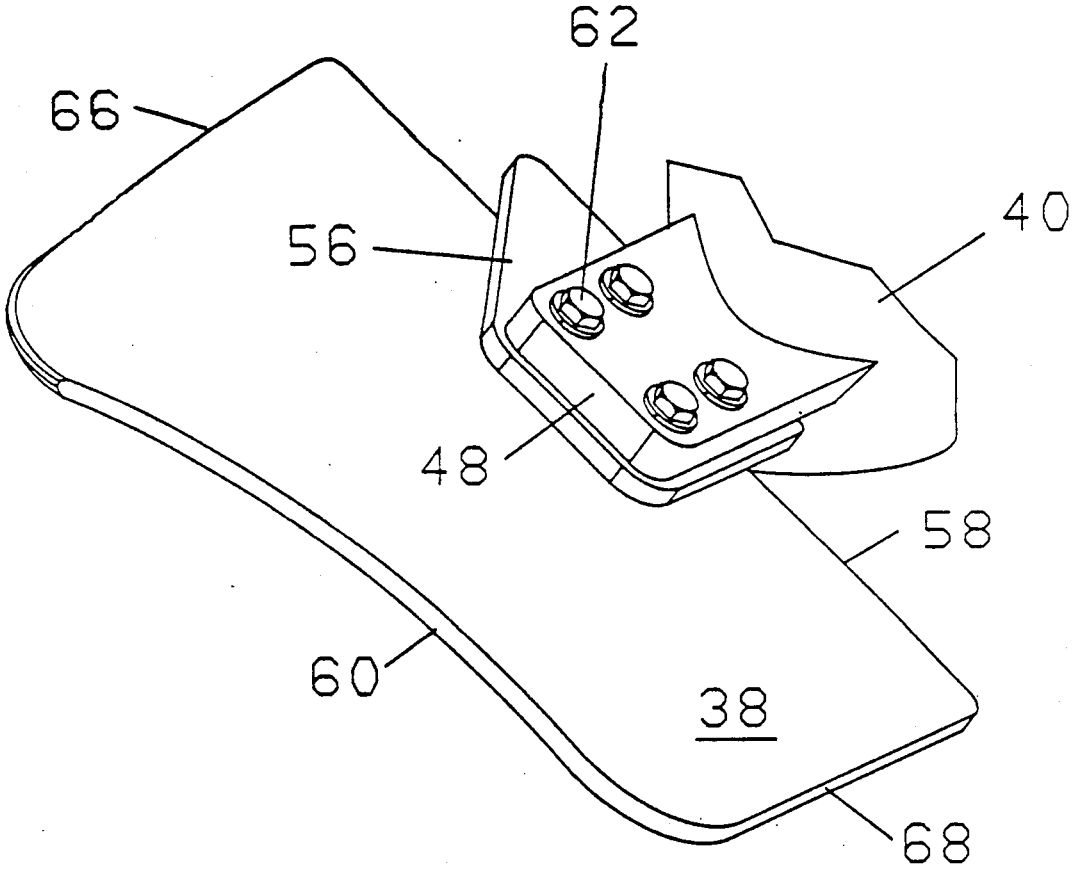
FIG. 3 is an enlarged view from the top in perspective showing one of the impeller blades, its hub, connecting arm and its backing plate.

Referring first to FIG. 1 there is shown the mixer 10 extending downwardly into a tank 12. the circular inside wall 14 and the base 16 of which appear from the top. This tank may be closed on the top. The shaft 18 extends axially of the tank along its center to a gear box and drive motor which with the shaft provides means for its rotation and the rotation of the impeller system of the mixer.

The impeller system in the mixer illustrated in FIG. 1 contains three four-bladed impellers 20, 22 and 24. The impeller 24 at the bottom may be of larger diameter than the other two impellers. It also may be a conventional shear type or radial flow impeller such as the R100 impeller (Ruston type) which is available from the Mixing Equipment Company, a Unit of General Signal Corporation, 135 Mt. Read Boulevard, Rochester, N.Y. 14603.

The tank may have, extending radially from its inside wall 14, a plurality of baffles or fins 26. The mixing system is also designed to sparge gas, such as air or oxygen which enters via piping 28 to a sparge ring 30 of rectangular form, which is disposed at or near the bottom 16 of the tank and below the lower most impeller 24. An open pipe, which like the ring provides a stream of gas bubbles, may alternatively be used. It is these gas bubbles, which create the non-uniform flow field in the tank. Such a flow field interferes with the axial flow produced by the impellers 20 to 24 and gives rise to variable stresses therein particularly where they are attached to the shaft.

The impellers each have four blades which are generally rectangular plates. The four blades of the uppermost impeller 20 are indicated at 32, 34, 36 and 38. Each of these blades is identical and is attached to a hub 40 which is keyed and attached to the shaft. The hub may be a split hub which is bolted to the shaft. Extending from the hub are four arm members, equally spaced 90° apart. These arm members are bars 42, 44, 46 and 48 which are flat on their undersurface where they are connected to the plates via backing plates 50, 52, 54 and 56.

The blades have base edges, such as shown at 58 for the blade 38, which are spaced from the hub so that the blades may have no greater than a certain width between their tips 60 and their bases 58. The principal pumping action occurs at the tip 60. The tip is desirably made wide and at least 40% of the diameter in width at a distance of 90% of the radius from the axis of the shaft 18. Other paddle shapes than rectangular having such a tip configuration are useable. However the rectangular shape is preferred.

The use of paddle blades, such as are substantially rectangular, and have a limited width. Such blades are normally retrofitted onto existing mixer installations. The principal access to the mixer is through a manway or manhole in the tank, which is otherwise enclosed. By providing impeller blades of the shape described in this application, such blades can readily be brought into the tank and installed on the shaft.

The backing plates 50 to 56 are generally trapezoidal and have leading edges which are inclined to the base 58. The backing plates reduce the space between the base 58 and the shaft and reduce the flow of gas through this space, thereby enhancing gas handling and promote the axial flow of the gas with the liquid through the tank. In the illustrated mixer the impellers are down pumping and pump the liquid or liquid suspension axially downward. Then the liquid flows axially upward from the bottom of the tank along the sides of the tank there guided by the baffles 26, which reduce swirling at the walls of the tank 14.

Another important feature arising out of the means for attachment of the blades is that the blades are formed so that they have a flat region or section at the area of attachment to the hub arms 42 to 48. The backing plates 50 to 56 are also flat. The backing plates also spread the load which is applied by the fluid environment on the blades and reduce stress concentrations on the blades. The flat sections of the blades, the backing plates and the arms have aligned holes (four holes being used) through which bolts 62 extend. These bolts are fastened by nuts on the under or pressure sides of the blades. Because the surfaces to which the bolts are connected and through which the bolts extend are flat, cocking of the bolts or nuts is prevented. The preload on the bolts, which is obtained when the bolts are initially tightened in place, is maintained. Such a preload provides the strength in principal part to a bolted connection. Bolted connections are stronger and more reliable than welded connections in a dynamic environment.

In the dynamic environment in which the impellers are disposed they can be subject to large dynamic loads. Such loads are only exacerbated by the non-uniform and non-homogenous flow field when sparging gases are in the environment. Welded connections at the hub tend to fail. Bolted connections to a non-flat surface make contact at either the head or nut of the bolt, or both, at a limited area. These minimal areas of contact tend to work loose thereby losing the preload on the bolted connection and its principal strength. The blades then can vibrate and can either work loose the bolts or provide a flexural failure. The attachment means, provided by the invention, utilizing a flat area on the blade, and a flat arm on the hub provides a strong connection which is not subject to failure. This connection is enhanced and the further benefits of controlling the flow of the gas are obtained using the backing plates 50 to 56.

Figure 5:
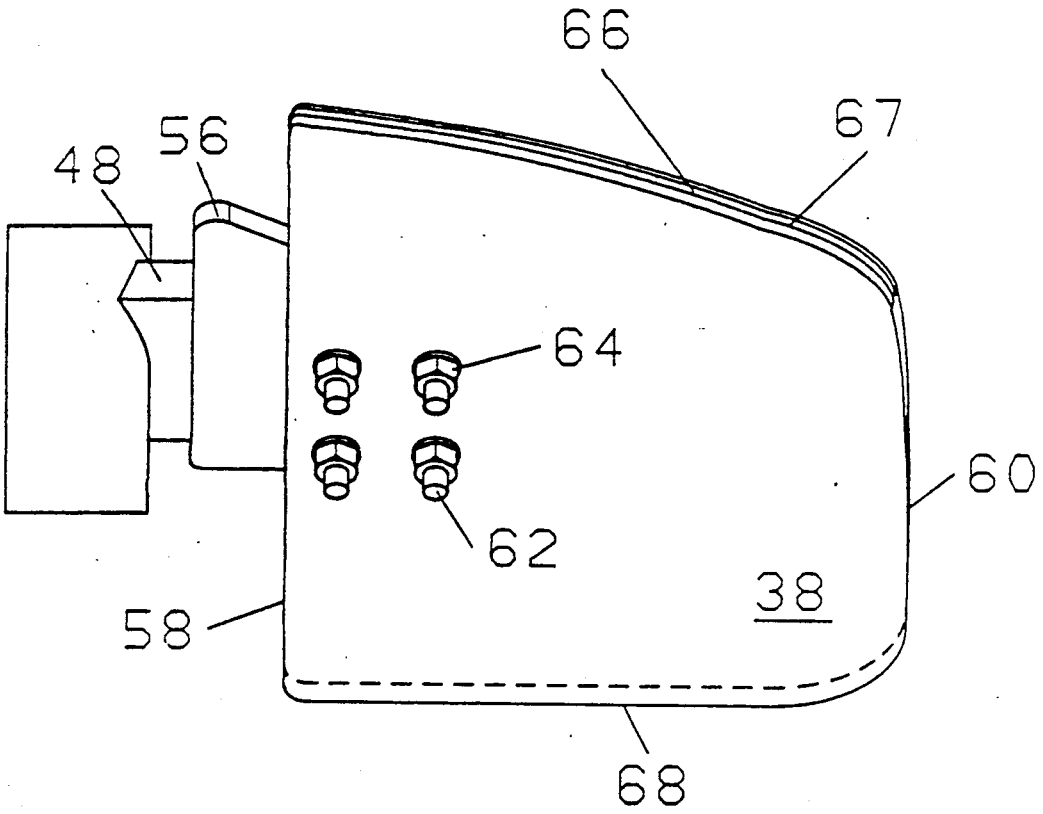
FIG. 5 is a side view of the impeller, looking toward the leading edge of one of the four blades.

High efficiency pumping so as to provide large flow volumes, as well as the shape of the blade to provide the flat section for the strong connection to the shaft are also provided by the blades. The mounting means, namely the hub, bolted arm and backing plates are also shown in FIGS. 2, 3, 5 and 7. The nuts 64 on the bolts 62 are best seen in FIG. 5 which views the blade 38 from the front looking into its leading edge 66. The camber of the blade and its pitch or hub chord angle (HCA) will also be apparent from the location of the trailing edge 68 below and behind the leading edge 66. It will also be observed that the blades overlap each other, the leading edges of the blades overlying the trailing edges of their preceding blades.

Figure 4:
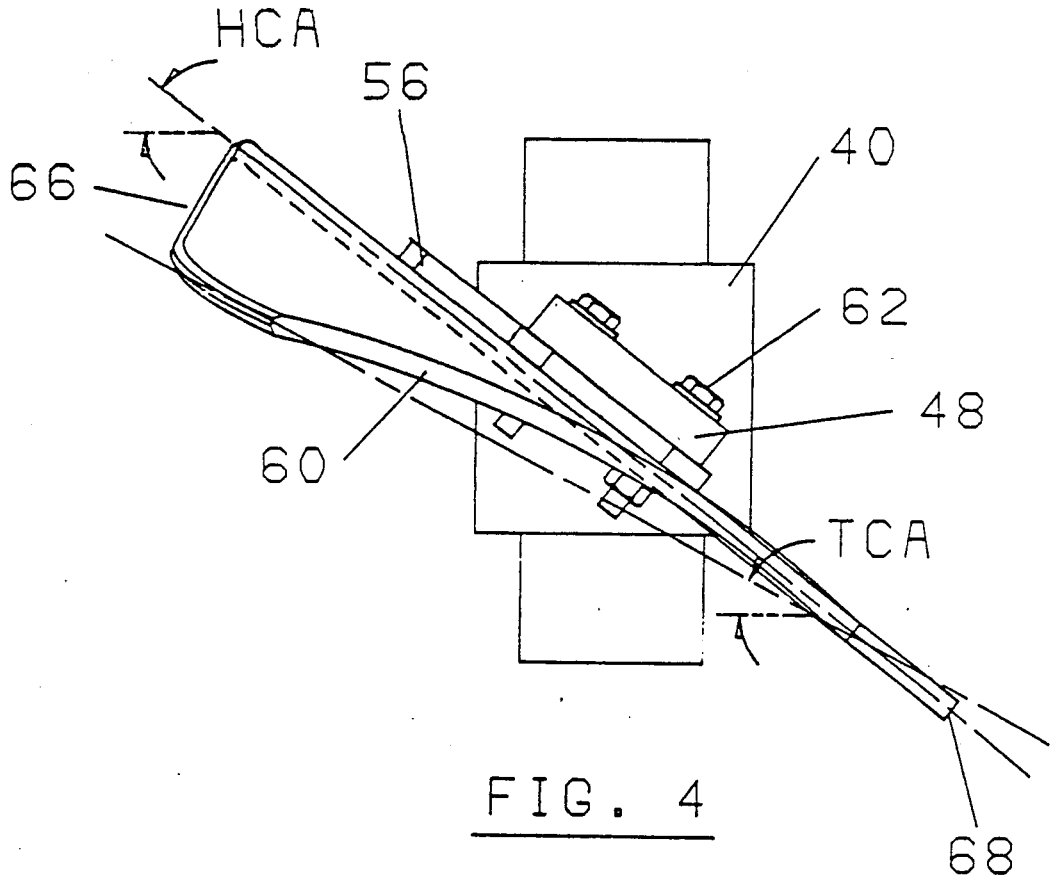
FIG. 4 is an end view of a blade looking toward the tip of the blade.

Referring to FIGS. 2, 3, 4, 5 and 7 it will be seen that each impeller blade, of which the blade 38 which is shown enlarged in the figures is typical, is a plate having a compound curvature to define an airfoil having camber between its leading and trailing edges as well as twist. The pitch of the blade is set by the inclination of the hub arms 42 to 48 with respect to a plane perpendicular to the axis of the shaft 18. Due to the twist in the blade the pitch can vary from the angle at the tip or tip chord angle (TCA) to the angle nearest the hub or hub chord angle (HCA) as shown in FIG. 4. Typical and preferable values of TCA are 28% and of HCA are 38° (approximately). The TCA may vary from approximately 18° and 34°. The twist (the difference between the HCA and TCA) may vary between 8° to 12° (approximately). The pitch angle, at approximately 0.7 or seventy percent of the radius from the shaft axis, may suitably be approximately 34° .

Figure 7:
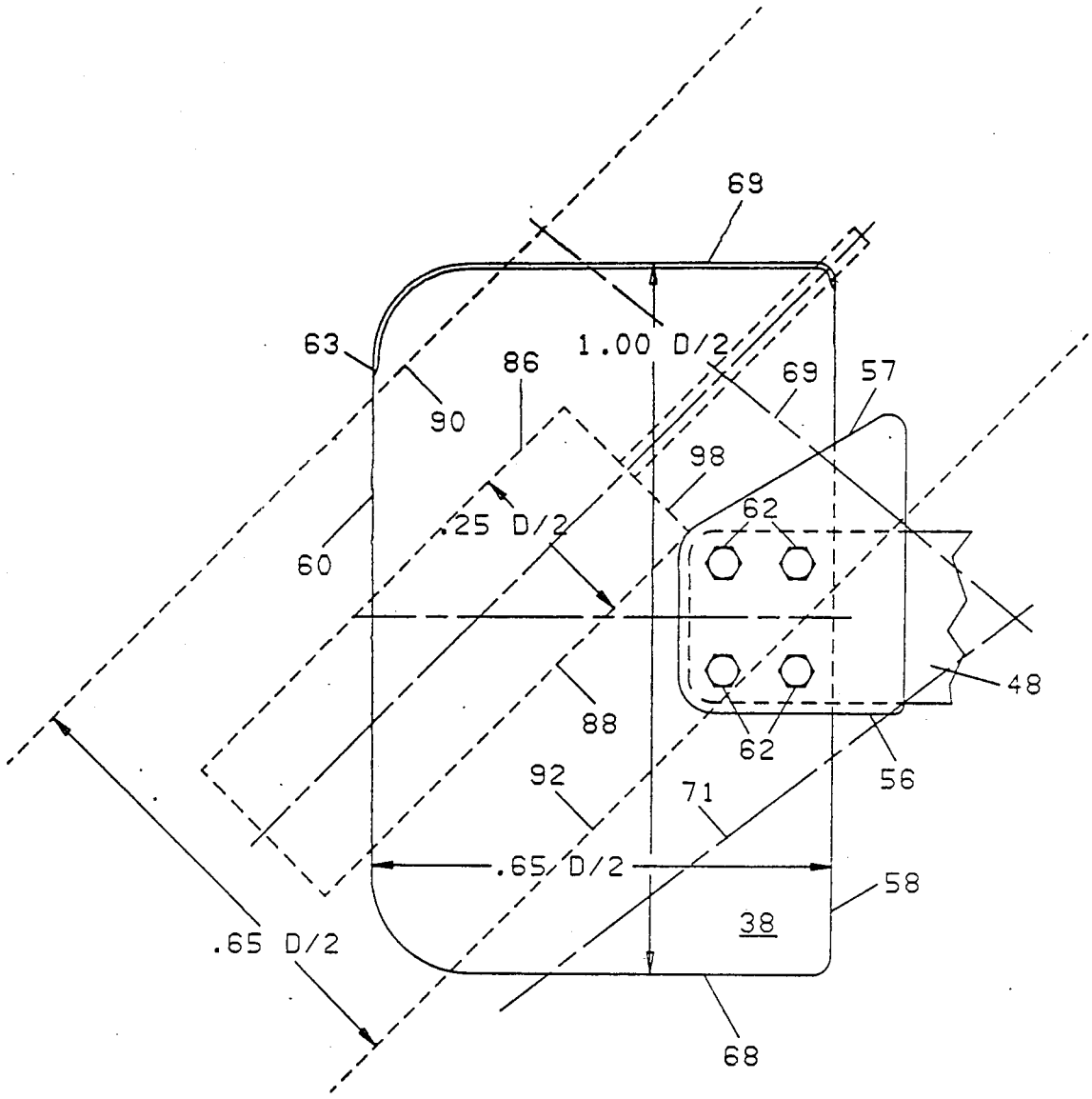
FIG. 7 is a planform of an impeller blade and its backing plate.

The camber and twist are obtained simultaneously in the fabricating process which will be described more fully in connection with FIGS. 7 through 10. As pointed out above, the blade curvature is complex and leaves a flat region along the bisector of the blade (the blade center line) which is close to the hub center line as shown in FIG. 7. In this embodiment of the invention the flat region extends from the base 58 of the blade towards the front to at least 50% of the radius (0.5 D/2) as shown in FIG. 7 and thence towards the trailing edge 68. This flat region will also be apparent from the end view shown in FIG. 5. The blade is curved along an arc towards its leading edge 66 to provide the requisite camber (the distance between the chord and the midline through the thickness of the blade). The camber as a percent of the chord may vary from approximately 4% to 8% at the tip to 0% to 4% at the base. Nominally the camber may vary from 6% at the tip to 0% at the base.

The corners of the blade between the tip 60 and the leading and trailing edges 66 and 68 are rounded. The tip of the blade is straight in planform for approximately 70% of its length. This straight section reduces the width of the blade while keeping the large effective radius of the impeller determined by the radius at the tip leading edge. As pointed out above the width is desirably limited to enable the blade to be brought through a manway for installation on the mixer shaft with the hub and backing plates. The radius at each corner is approximately 15% of the length of the blade between its leading and trailing edges.

It will also be seen from FIG. 7 that the leading edge 66 is swept back with respect to a radial line 69 from the shaft axis. The trailing edge is also swept forward with respect to a radial line 71 from the shaft axis. The leading edge of the mounting plate 56 therefore not only does not interfere with the pumping action but also assists such action. The leading edge is desirably inclined. The leading edge has a double chamfer as shown in FIG. 5 at 67. Such a contoured leading edge facilitates efficiency (reducing leading edge separation) for axial flow pumping. The leading edge may also be radiused. It may also have a blunt leading edge if added turbulence is desirable.

The method for fabricating the blades will be more apparent from FIGS. 7 to 10. The method used is in the class of air bending using bar like tools 80, 82 and 84. These tools are used in a press and brought together and pressed down to bend the plate of metal, such as steel or stainless steel from which the blade 38 is formed. The plate is disposed between the tools and the edges 86 and 88 of the tool 84 define two parallel lines of contact on one side of the plate 38. The inside edges 90 and 92 define another pair of lines of contact at greater separation than the lines 86 and 88. All of the lines shown are approximately parallel to each other. The lines of contact may also be nonparallel.

The upper tool 84 has an extension bar 94 along its center line which can contact the base end or corner of the base end and the leading end to prevent it from deflecting during the bending operation. Also a block 96 may be disposed under the upper tool 84 to limit the deflection of the plate during bending to control camber. The use of the block 96 is optional.

Figure 8:
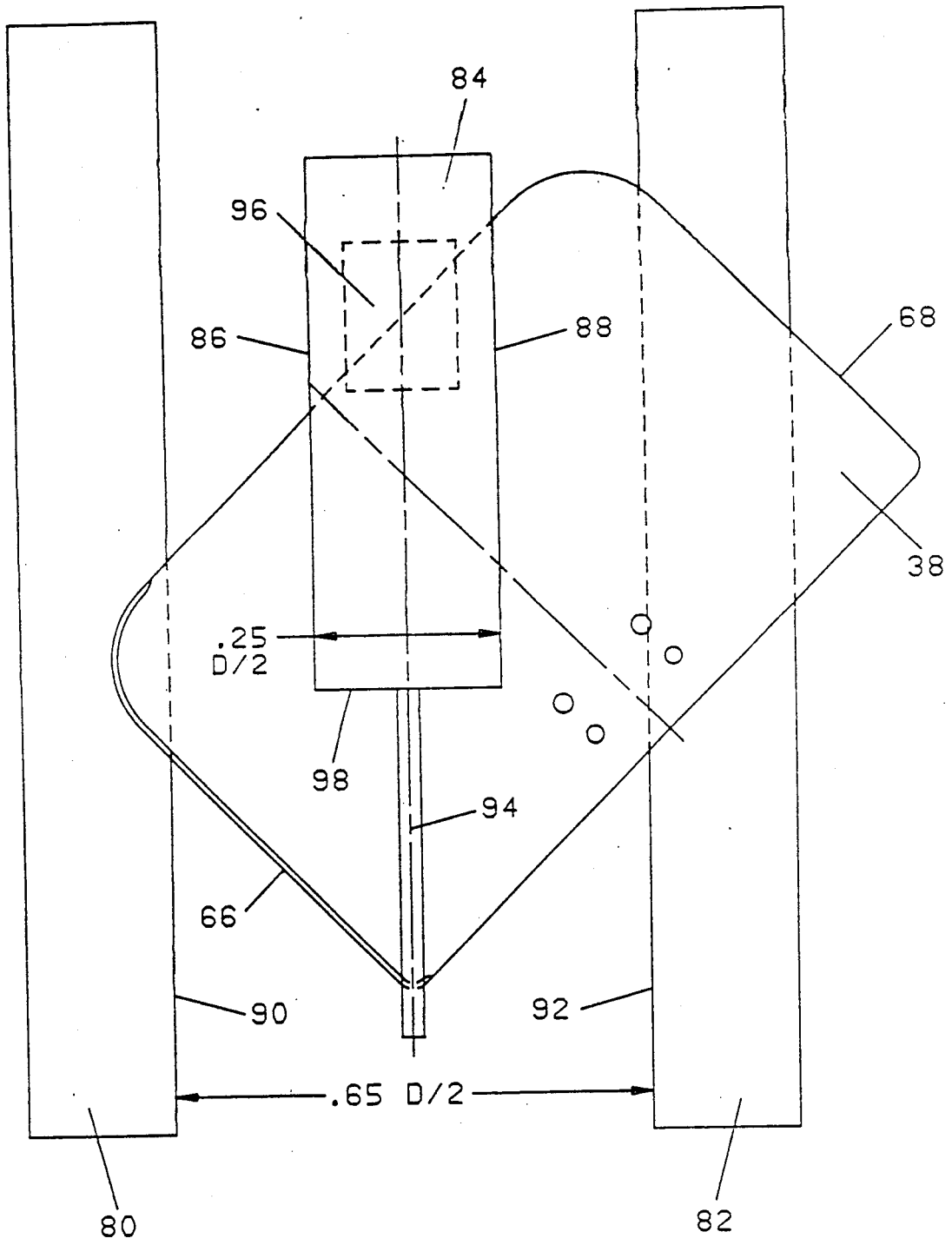
FIG. 8 is a top view showing, schematically, the blade forming apparatus used to fabricate the blades shown in FIGS. 1 through 7.
Figure 9:
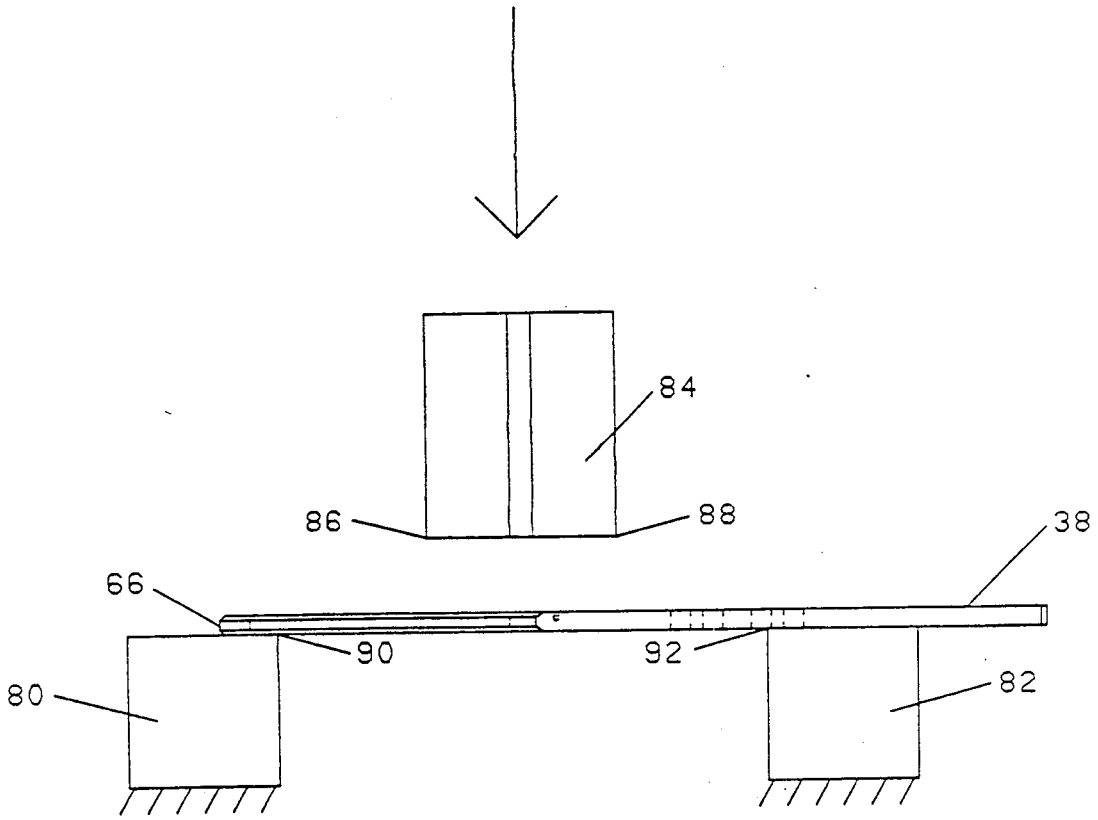
FIGS. 9 and 10 are front views of the apparatus shown in FIG. 8 in two positions during its operation.
Figure 10:
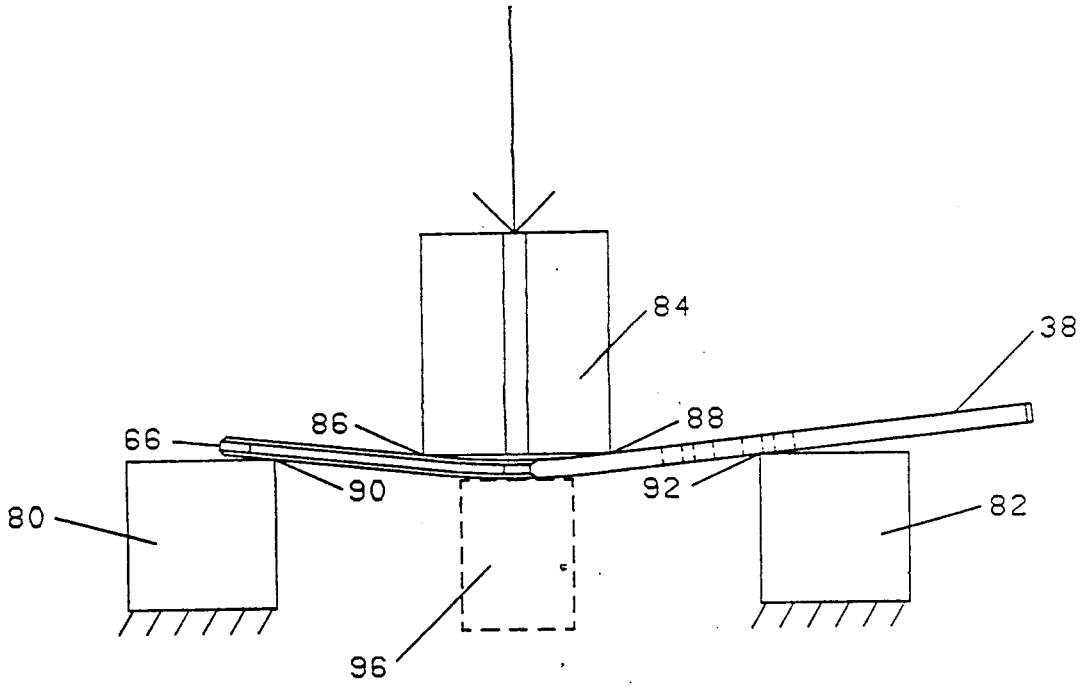

In order to provide the requisite camber and to define the flat section of the blade, the tools are inclined at an angle to the leading and trailing edges. Preferably, the upper tool and its edges are disposed at an acute angle to the tip but do not extend beyond 0.5 D/2 as shown in FIG. 8. The other contact lines 90 and 92 are also shown in FIG. 8 as are their typical displacements with respect to the contact lines 86 and 88. The spacing of the outer contact lines 90 and 92 is suitably the same as the width of the blade (0.65 D/2) in the exemplary blade shown in FIG. 7. It will be noted that the rear edge 98 of the upper tool 84 is spaced from the leading edge so as to avoid forming kinks in the leading edge 66 of the blade 38.

When the tools are brought together, as in a press or brake a bending moment is applied which forms the plate 38 into an arc of generally circular shape. Since the trailing edge is unsupported the portion of the blade including the trailing edge remains with flat surfaces. Because of the angular orientation of the tools 82 and 84 with respect to the blade edges, the requisite camber and twist are simultaneously formed. The press exerts sufficient force to deflect and bend the plate beyond its elastic limit so that the requisite shape, including camber and twist, are retained after pressing.

For variations in twist and camber the tools may be rotated or their dimensions changed. Accordingly, compound curvatures, both curved and flat, may readily be formed, wherever desired, on the plate.

Figure 6:
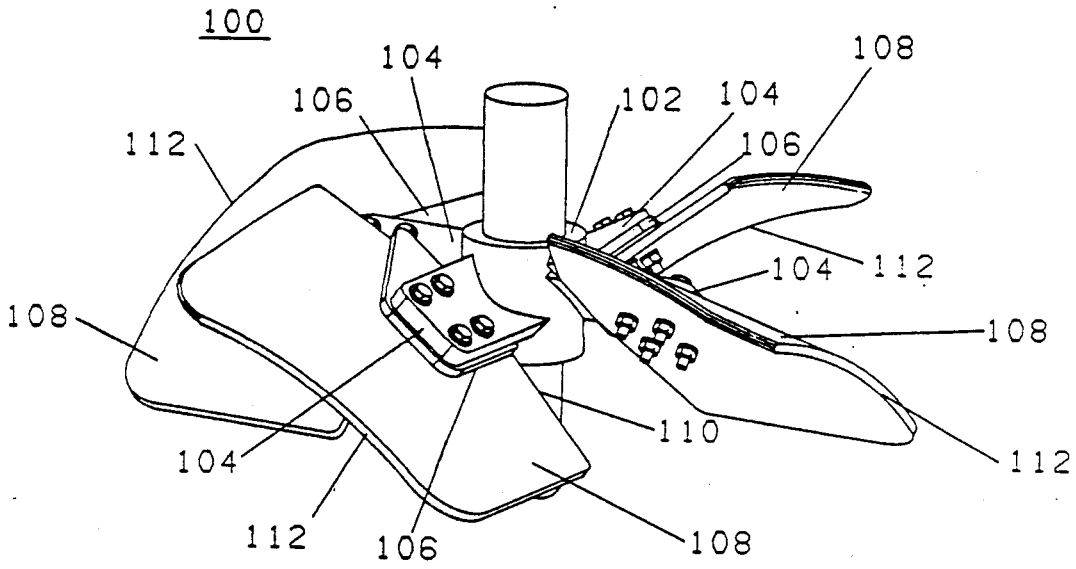
FIG. 6 is a perspective view of an impeller and its hub in accordance with another embodiment of the invention.

Referring to FIG. 6 there is shown another embodiment of an impeller 100. This impeller has a hub 102 of a design similar to the hub 40 with arms 104 and backing plates 106 which provide a strong connection to the blades 108. These blades may be formed to provide camber and twist and may be mounted at the requisite pitch angles in the same manner as described in connection with FIGS. 1 through 5 and 7. The base end of the blade, however, is trapezoidal in shape as shown at 110 and extends to the hub 102. The important feature of the invention of providing for high efficiency axial flow is obtained since near the tip 112 the width of the blade is maintained. Specifically near the tip or at approximately 0.9R (the radius from the center of the shaft (the shaft axis) to the tip the blade) is at least 40% of the blade diameter. Accordingly the features of the invention can be provided with other paddle like shapes such as shown in FIG. 6.

From the foregoing description it will be apparent that there has been provided improved methods of fabricating the impeller blades useful in mixing apparatus. Variations and modifications of the mixer apparatus will undoubtedly suggest themselves to those skilled in the art. For example the backing plate may be made integral with the arms of the hub instead of in two pieces as described in the foregoing embodiment. The plate may also be extended and shaped in other shapes rather than the preferred trapezoidal shape of the backing plate, as illustrated. In the method of forming the blade other lines and points may be used to control the bending and to provide other contours. These may be effected by additional tools or by extensions and projections from the tools which are illustrated herein. The mixer system utilizing the blade configurations and shapes of the impeller is also useful in applications where the system is operative beyond flooding. Then, while the flow will not be predominantly axial, there will be sufficient flow in a radial direction to maintain mixing and gas dispersing action. It will also be appreciated that the mixer apparatus can be used as a side entry rather than a top entry mixer and is especially adapted for such use when there are non-uniform flow fields in the vicinity of the impeller. The mixer apparatus could also be used in mixer applications where the flow is nearly uniform but the loads on the blades are very large. Other variations and modifications of the herein described mixer and the method of blade fabrication, within the scope of the invention will undoubtedly suggest themselves to those skilled in the art. Accordingly the foregoing description should be taken as illustrative and not in a limiting sense.

We claim:

1. The method of making an impeller blade from a metal plate which comprises the steps of locating said plate with respect to tools on opposite sides thereof, which tools have edges which define a first pair of lines contacting said plate on one side thereof and a second pair of lines generally in the same direction as said first pair of lines and generally in the same direction as said first pair of lines and having greater separation than said first pair of lines and contacting said plate on the opposite side thereof, bringing said tools toward each other to apply a bending moment to said plate bending said plate beyond its elastic limits to define a section curved along an arc between where said first pair of lines contact said plate, which arc continues into a region of lesser curvature than said arc beyond where said second lines contact said plate to provide camber in said blade.

2. The method according to claim 1 wherein said locating step is carried out to locate said lines of contact offset with respect to the center of said blade.

3. The method according to claim 1 wherein said plate is rectangular and has a pair of edges along the width and another pair of edges along the length thereof, and said locating step is carried out by locating said plate with respect to one of said tools providing the first pair of lines so that said first pair of lines intersect one edge of one of said pairs of edges without intersecting the other edge of said one pair of edges.

4. The method according to claim 3 wherein said locating step is carried out by locating said tools with respect to said edges to define angles differing from 90° with said edges.

5. The method according to claim 4 wherein said locating step is carried out by locating said tools which define one of said second pair of contact lines to intersect adjacent edges one along the width and one along the length of said plate which define a first corner of said plate, and locating said tools which define the other of said second pair of contact lines to intersect said one of said adjacent edges along the length of said plate beyond the midpoint thereof and the other of said edges along the length of said plate at a point closer to said one of said adjacent edges along the width of said plate than the midpoint of said other of said edges along the length thereof, and with the tool defining said first pair of contact lines intersecting only said one of said adjacent edges along the length of said plate.

6. The method according to claim 5 wherein said locating step is carried out so that a line between said first pair of contact lines extends through the corner of said plate defined by said one of said edges along the width thereof and the other of said edges along the length thereof whereby when said plate is pressed and bent by said tools said plate will have a curved section and a flat section.

7. The method according to claim 1 wherein said locating step is carried out with at least the first pair of lines of contact being parallel.

8. The method according to claim 7 wherein said locating step is carried out with all of said lines of contact being parallel.

* * * * *